US006455817B1

(12) United States Patent
Guzzi et al.

(10) Patent No.: US 6,455,817 B1
(45) Date of Patent: Sep. 24, 2002

(54) STRUCTURE FOR HOUSING A WORKPIECE DURING CURING AND ASSOCIATED METHOD

(75) Inventors: Miguel A. Guzzi, Winnipeg (CA); Craig S. W. Humeny, San Diego, CA (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 09/935,313

(22) Filed: Aug. 22, 2001

(51) Int. Cl.[7] ..... F27B 17/00; F27D 1/18

(52) U.S. Cl. ..... 219/400; 219/385; 219/386

(58) Field of Search ..... 219/400, 385, 219/386, 200, 201, 213; 34/202, 218, 220, 221; 432/199, 247, 250

(56) References Cited

U.S. PATENT DOCUMENTS 2,701,921 A * 2/1955 Strongson ..... 219/400
3,577,650 A * 5/1971 Brahm ..... 219/400
4,412,817 A * 11/1983 Schmidgall ..... 432/247
5,147,136 A * 9/1992 Hartley et al. ..... 374/57
5,528,840 A * 6/1996 Pajak et al. ..... 34/202
5,548,100 A * 8/1996 Miller ..... 219/385
6,097,001 A * 8/2000 Richardson et al. ..... 219/400

* cited by examiner

*Primary Examiner*—Joseph Pelham
(74) *Attorney, Agent, or Firm*—Alston & Bird LLP

(57) ABSTRACT

A structure and an associated method are provided for housing a workpiece during curing such that the cure process may be accelerated without requiring the use of a relatively expensive cure room. The structure includes a cure room, typically formed by a tent, that defines a cure chamber in which the workpiece is disposed. The tent is generally at least partially retractable to permit introduction and removal of the workpiece. The tent typically includes a frame and a covering supported by the frame. The covering may be formed of a relatively flexible cloth and preferably has an inner surface formed of a thermally insulating, heat reflecting, fire resistant material. The structure is preferably portable and, as such, may include means, such as a plurality of wheels, for moving the cure room, typically defined by the tent, between the first and second locations.

24 Claims, 2 Drawing Sheets

STRUCTURE FOR HOUSING A WORKPIECE DURING CURING AND ASSOCIATED METHOD

FIELD OF THE INVENTION

The present invention relates generally to structures for housing a workpiece during curing and associated methods and, more particularly, to relatively inexpensive structures that facilitate the curing of workpieces on the shop floor or the like and, in some embodiments, are portable so as to be moved from location to location as desired.

BACKGROUND OF THE INVENTION

During many manufacturing operations, it is required to cure a workpiece or at least a coating that has been applied to the workpiece. For example, during the construction of an aircraft, sealants and other coatings are oftentimes applied at different times to an article under construction. Prior to continuing with the construction of the article, the sealant or other coating must frequently be cured. While different sealants or other coatings may require different conditions for curing, most materials cure according to some function of time and temperature. As such, workpieces that must be cured can simply remain on the shop floor or elsewhere for some period of time in order to cure. While the times required for various types of sealants and other coatings to cure also vary, it is not uncommon for workpieces to require several days to properly cure prior to continuing with the construction of the article. As will be apparent, the delay introduced into the construction process as a result of the curing cycle is disadvantageous and adds to the overall cost of the article. Moreover, the workpiece oftentimes remains on the shop floor during curing and therefore consumes a portion of the oftentimes limited space available on the shop floor.

The curing process can generally be accelerated by increasing the temperature of the workpiece during the cure process. Cure rooms have therefore been developed to accelerate the cure process. In this regard, cure rooms are generally thermally insulated rooms in which workpieces can be placed during curing. While the workpieces are disposed within the cure room, the temperature within the cure room can be increased and air can be circulated through the cure room in order to accelerate the curing process. While cure rooms are generally successful in reducing the overall time required to cure a workpiece, cure rooms are relatively expensive to construct and may cost $10,000, $15,000 or more. As a result of the cost, not all companies that must cure a workpiece during a manufacturing process have constructed a cure room. Moreover, cure rooms are fixed in position within a manufacturing facility. As such, workpieces that must be cured must be transported to the cure room for curing and thereafter removed from the cure room. While the transportation of some workpieces to and from the cure room is relatively simple, other workpieces may be difficult to transport to a cure room due to the size, shape or weight of the workpiece.

By way of example, the door of an aircraft includes a latch and hinge assembly. During the fabrication process, the latch and hinge assembly is coated with a sealant which must cure prior to continuing the fabrication process. In this regard, the construction process cannot continue until the sealant has cured because of the risk of contamination and disruption to the fey seals.

One common sealant for the latch and hinge assembly has a cure time of 48 hours at room temperature. While the curing of the sealant may be accelerated by placing the door in a cure room, a cure room may not be available or, if available, may be a substantial distance from the location at which the door is being fabricated. As such, the door would be required to be placed upon a transportation device, such as a mobile table, a transportation cart or the like, and moved to the cure room. Since the door is quite heavy and large, it would be difficult to readily move the door to and from the cure room. As such, the door frequently sits on the shop floor during the curing process, such as for 48 hours or so, prior to continuing the fabrication process. Since space on the shop floor is oftentimes in limited supply, the door may prevent other objects from being placed on the shop floor. In addition, the door may actually get in the way or obstruct other operations conducted on the shop floor during the curing process. As such, it would be desirable to accelerate the curing process without requiring that the article under construction be transported to the relatively expensive cure rooms utilized in some manufacturing facilities.

SUMMARY OF THE INVENTION

A structure and an associated method are therefore provided for housing a workpiece during curing such that the cure process may be accelerated without requiring the use of a relatively expensive cure room. In this regard, the structure of the present invention may be relatively inexpensive and, in one embodiment, includes a tent that serves as the cure room in which the workpiece is disposed during curing. In addition, the structure of one advantageous embodiment is portable such that the structure may be moved to the location of the workpiece that requires curing in order to prevent the workpiece from having to be transported to a cure room or the like.

According to one aspect of the present invention, a structure is provided for housing a workpiece while at least a portion of the workpiece is curing. The structure includes a cure room, typically formed by a tent, that defines the internal cure chamber in which the workpiece is disposed during curing. The structure may include a heater in communication with the internal cure chamber to heat the workpiece so as to accelerate curing. In addition, the structure may include a fan for circulating air through the internal cure chamber during the curing process.

The tent that preferably defines the internal cure chamber is generally at least partially retractable to permit introduction of the workpiece into the internal cure chamber and the removal of the workpiece therefrom. In this regard, the tent may include a frame and a covering supported by the frame. The covering is typically formed of a relatively flexible cloth or other material and preferably has an inner surface formed of a thermally insulating, heat reflecting, fire resistant material. The frame is adapted to move between a first position which defines an opening to the internal cure chamber to permit the introduction of the workpiece into the internal cure chamber and the removal of the workpiece from the internal cure chamber and a second position in which the opening is closed while the workpiece is cured.

The tent and, more particularly, the frame may include an upstanding wall and a retractable portion extending downwardly and outwardly from the upstanding wall. In order to carry the covering that forms the retractable portion of the tent, the frame may also include at least one and, more typically, a plurality of arms extending outwardly from the upstanding wall. In this regard, the plurality of arms may extend outwardly from a lower portion of the upstanding wall. The plurality of arms are preferably adapted to move between a first position in which the arms extend upwardly along the upstanding wall and a second position in which the plurality of arms are fanned outwardly so as to define different respective angles with the upstanding wall. Thus, by positioning the plurality of arms in the first position, the covering is retracted to permit the workpiece to be introduced into or removed from the internal cure chamber. In order to secure the covering while the frame is in the first position, the tent may also include a strap. By positioning the plurality of arms in the second position, however, the covering is extended downwardly and outwardly from the upstanding wall so as to close the opening and more completely define the internal cure chamber within which the workpiece is disposed.

According to one embodiment, the structure is portable and is therefore capable of being moved between at least first and second locations. As such, the portable structure may include means, such as a plurality of wheels, for moving a cure room, typically defined by the tent, between the first and second locations. As such, the structure may be moved to the location of a workpiece in need of curing in order to avoid transporting the workpiece to a remote cure room or the like.

In operation, the portable structure of the present invention may be moved to the location of a workpiece that is to be cured. At least a portion of the tent is then retracted, such as by being folded in an accordion-like fashion, to provide an opening to the internal cure chamber. The workpiece is then introduced into the internal cure chamber and the tent is repositioned so as to close the opening. Thereafter, the workpiece is cured, such as by heating the internal cure chamber while circulating air therethrough. Once the workpiece has been cured, at least a portion of the tent may again be retracted to define the opening to the internal cure chamber and the workpiece may be removed therefrom through the opening.

Therefore, the structure and method of the present invention permit workpieces to be cured relatively inexpensively and in an accelerated manner. In this regard, the structure is generally formed of a tent that may be at least partially retracted in order to permit the insertion and removal of the workpiece. By utilizing a tent to define the internal cure chamber, the cost of the resulting structure can be substantially reduced relative to a conventional cure room. In addition, the structure of the present invention may be portable so as to be readily positioned proximate a workpiece without requiring that the workpiece be transported.

BRIEF DESCRIPTION OF THE DRAWINGS

Figure 1:
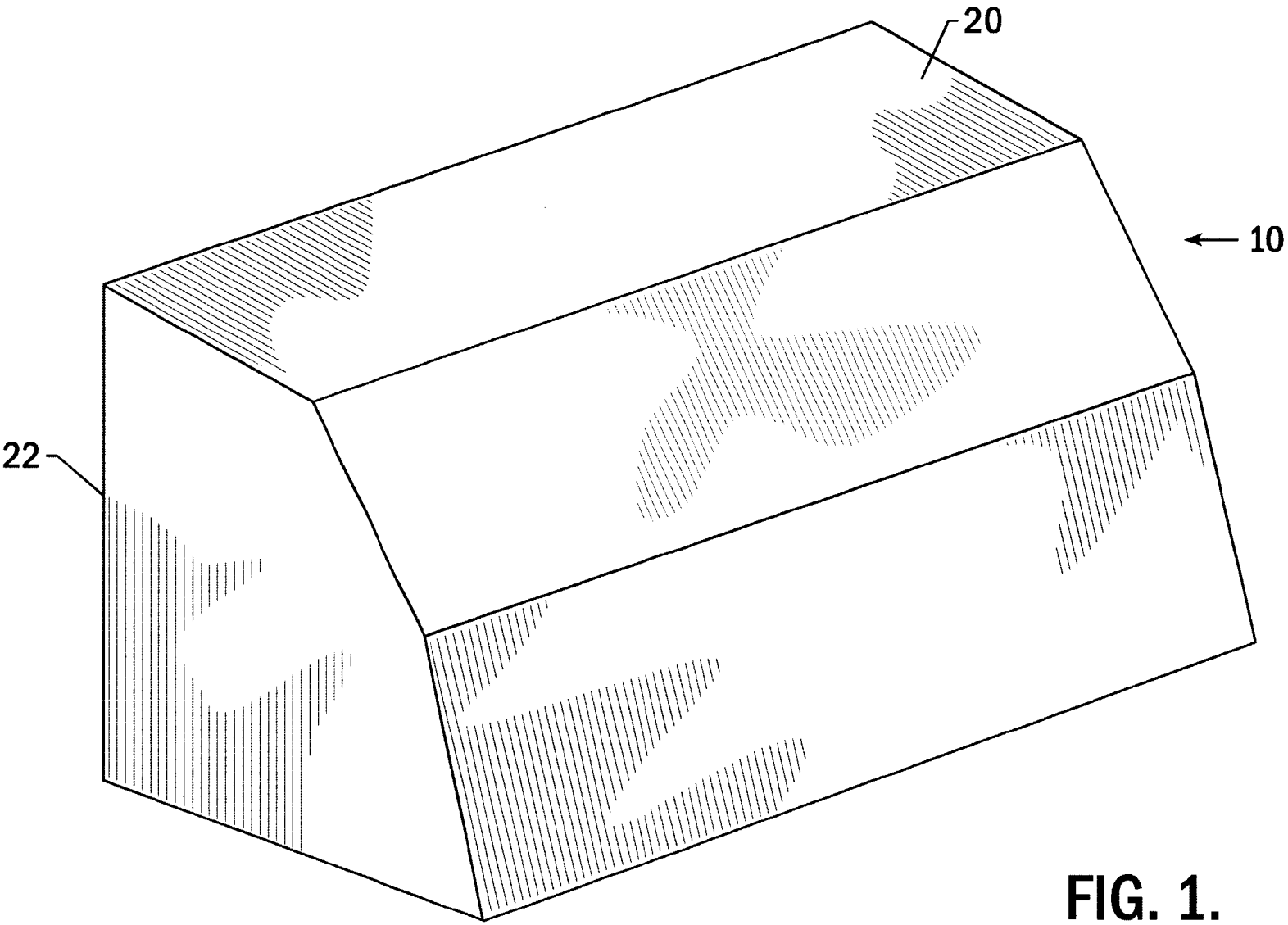
Figure 2:
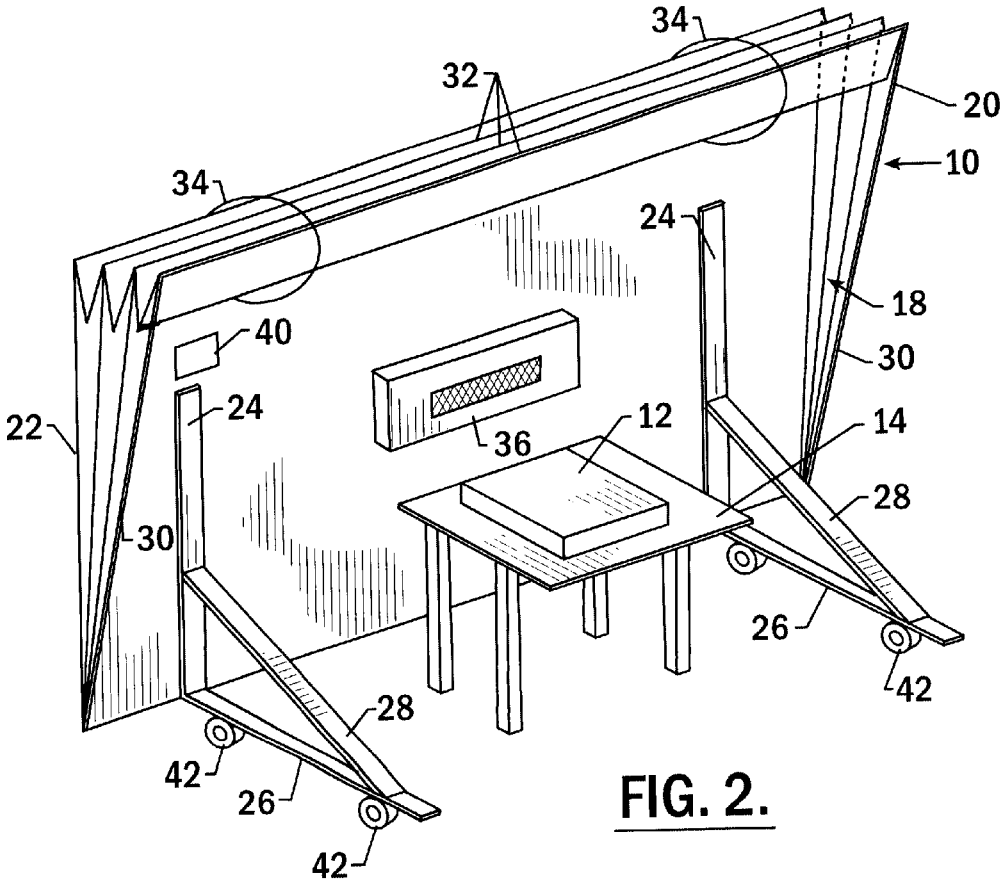
Figure 3:
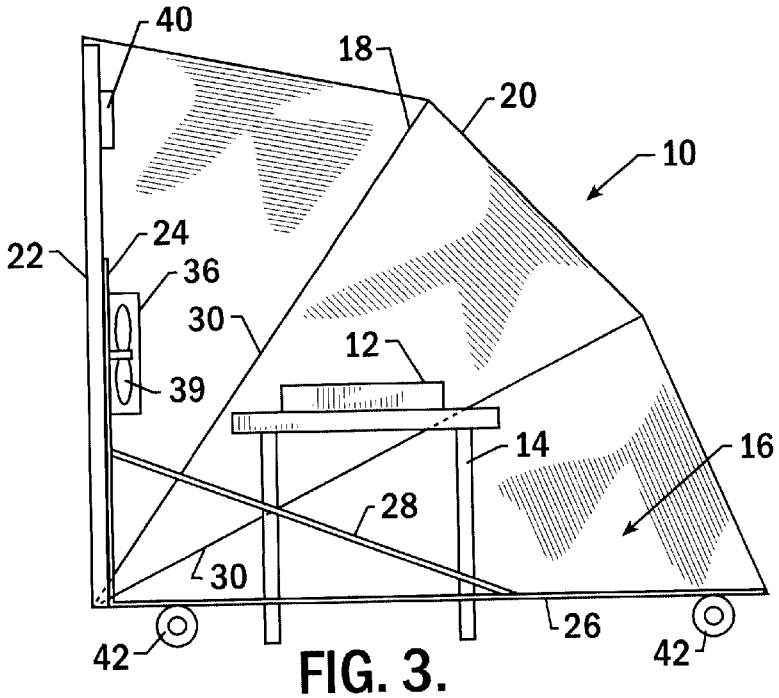

Having thus described the invention in general terms, reference will now be made to the accompanying drawings, which are not necessarily drawn to scale, and wherein:

FIG. 1 is a perspective view of a structure for housing a workpiece during curing according to one embodiment of the present invention in which the tent is closed;

FIG. 2 is a perspective view of the structure of FIG. 1 in which the tent has been retracted to permit the introduction and removal of the workpiece; and FIG. 3 is an end view of the structure of FIG. 1 which depicts the plurality of arms fanned outwardly from the upstanding wall and schematically illustrates a heater and a fan for curing a workpiece disposed within the tent.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Referring now to FIGS. 1–3, a structure 10 for housing a workpiece 12 while at least a portion of the workpiece is cured is depicted. The structure of the present invention can be utilized to accelerate the curing of a wide variety of workpieces in a wide variety of manufacturing or fabrication facilities. Depending upon the particular application in which the structure is deployed, the structure is constructed so as to be appropriately shaped and sized to receive the workpieces that are to be cured. For purposes of example, but not of limitation, the structure will be hereinafter described in conjunction with the curing of a sealant that has been applied to an aircraft door and, more particularly, the latch and hinge assembly of an aircraft door. As depicted, the door is generally supported upon a table 14 during the curing process. However, other types of workpieces may be supported in other manners or may rest upon the floor or the like, if so desired.

The structure 10 of the present invention includes a cure room that defines an internal cure chamber 16 in which the workpiece 12 is disposed during curing. Once the workpiece is disposed within the internal cure chamber, the temperature within the internal cure chamber may be increased so as to accelerate the curing process. The cure room is preferably constructed in a less expensive manner than conventional cure rooms having fixed walls. In this regard, the structure of one advantageous embodiment includes a tent that serves as the cure room and defines the internal cure chamber. While the tent may be constructed in various manners, the tent advantageously includes a frame 18 and a covering 20 supported by the frame. While the covering may also be constructed of various materials, the covering is typically a cloth or other flexible material to permit the covering to be alternately retracted and extended as described hereinbelow. For example, the covering may be comprised of vinyl. In order to increase the efficiency with which the workpiece is heated, the inner surface of the covering may be formed of a thermally insulating, heat reflecting material. For example, a vinyl covering may include a layer of silver cloth on the inner surface that faces the workpiece 12. As such, the thermally insulated, heat reflecting material will reduce the heat that escapes through the covering to the atmosphere and improve the efficiency with which the workpiece may be heated while within the structure of the present invention. In order to permit the structure to more safely heat workpieces to elevated temperatures, the material that forms the inner surface of the covering, such as the silver cloth, may also be fire resistant.

The tent may be constructed such that the covering 20 covers the entire frame 18. In the illustrated embodiment, however, the tent includes a wall 22 formed of a somewhat more rigid material. In this regard, the tent of the illustrated embodiment includes an upstanding wall with the covering supported upon the frame so as to extend outwardly and downwardly from an upper portion of the upstanding wall. The covering may be attached to the upper end of the upstanding wall to prevent any gaps between the covering and the upstanding wall that could otherwise disadvantageously permit heat to escape during the curing process. While the upstanding wall may be formed of various materials, the upstanding wall of one embodiment is formed of corrugated cardboard. In order to prevent significant amounts of heat from escaping through the wall during the curing process, the cardboard wall may be covered with the same material that forms the covering, such as vinyl. Alternatively, the cardboard wall may be covered with the same material that forms the inner surface of the covering, such as the silver cloth, so as to be thermally insulating, heat reflecting and fire resistant. It should be understood, however, that the upstanding wall may be formed in other manners or may include other types of coverings or coatings for reducing heat loss during the curing process.

In order to support the upstanding wall 22 and the covering 20, the frame 18 of the illustrated embodiment includes at least one and, more typically, a pair of wall supports 24 that are attached to and extend upwardly along the upstanding wall at spaced apart locations thereon. The frame also includes a floor support 26 extending outwardly from each wall support. In some embodiments, the frame may also include a brace 28 extending at an angle between each floor member and the respective wall member. The frame of this embodiment also includes at least one and, more preferably, a plurality of arms 30 which support the covering. For example, the frame of the illustrated embodiment includes two sets of arms positioned proximate the upstanding wall at opposite ends thereof. It should be understood, however, that the frame may include additional sets of arms, if desired.

The arms 30 of each set generally extend from a proximal end at which the arms are connected to one another to a distal end. As a result of the connection of the arms of each set at the proximal end, the arms may be moved from a first position in which the arms extend upwardly alongside the upstanding wall 22 to a second position in which the arms are fanned outwardly with the distal end of the arms spaced apart from one another. As shown in FIG. 3, the plurality of arms may be fanned outwardly from the upstanding wall at equal angular increments. For example, in the illustrated embodiment in which each set includes three arms, the arms may be fanned outwardly from the upstanding wall so as to define angles of 30°, 60° and 90° relative to the upstanding wall. However, the frame may include different numbers of arms and the arms can be positioned at other angles relative to one another and relative to the upstanding wall, if so desired.

In the illustrated embodiment, the frame 18 also includes a plurality of cross members 32, each of which extends between distal portions of the respective arms 30 of each set. Considering the illustrated embodiment of the frame in which the arms are fanned outwardly from the upstanding wall 22, a first cross member connects the respective arms of each set that define an angle of 90° with respect to the upstanding wall, a second cross member connects the respective arms of each set that define an angle of 60° with respect to the upstanding wall, and a third cross member would connect distal portions of the respective arms of each set that define an angle of 30° with respect to the upstanding wall.

The covering 20 may be draped over the arms 30 and the cross members 32 and connected thereto such that once the arms are fanned outwardly from the upstanding wall as depicted in FIGS. 1 and 3, the covering is stretched fairly tautly between the cross members and, on the opposed ends of the tent, between the plurality of arms. As explained below, the arms are generally fanned outwardly while the workpiece 12 is being cured since the covering is stretched outwardly and downwardly from an upper portion of the upstanding wall to the floor or other surface so to thereby define the internal cure chamber within which the workpiece is disposed. The arms are preferably fanned outwardly such that an outer edge of the covering contacts or is positioned proximate to the floor or other surface so as to limit the heat that may escape from the internal cure chamber during curing operations.

In order to permit the workpiece 12 to be introduced into and removed from the structure 10, the arms 30 are moved from the extended position shown in FIGS. 1 and 3 to a retracted position shown in FIG. 2. As illustrated, the arms may be retracted by moving the arms so as to extend alongside the upstanding wall 22. In this retracted position, the covering 20 is folded upon itself in an accordion-like fashion so as to be out of the way relative to the workpiece that is being introduced into or removed from the internal cure chamber 16. In order to secure the covering in the retracted position, the structure may also include at least one and, more typically, at least a pair of straps 34 for encircling the folded covering and securing the folded covering to an upper portion of the upstanding wall.

While the frame 18 and covering 20 of one embodiment have been illustrated and described, it should be understood that the frame and covering may be formed in other manners. For example, the frame may be fixed and may define one or more tracks that engage the covering and support and guide the covering between the extended and retracted positions.

The tent may be moved between the extended and retracted positions in various manners, including manually. In one embodiment, however, the structure 10 includes a motor for controllably moving the covering 20 between the extended and retracted positions.

In operation, the covering 20 is retracted and may be secured to the frame 18 by means of the straps 34 as shown in FIGS. 1 and 3. The workpiece to be cured is then positioned proximate the upstanding wall so as to be within the internal cure chamber 16 once the covering is extended downwardly and outwardly to the position depicted in FIG. 2. In other words, once the workpiece is properly positioned, the straps are released and the arms 30 are fanned outwardly from a position proximate the upstanding wall 22 to an extended position. As such, the covering is stretched over the plurality of arms and the plurality of cross members 32 to thereby define the internal cure chamber within which the workpiece is disposed.

Once the covering 20 is extended over the workpiece 12, the internal cure chamber 16 is heated to accelerate the curing process. In this regard, the structure 10 typically includes a heater 36, such as an electrical heater, disposed in communication with the internal cure chamber. As shown schematically in FIG. 3, the heater may be disposed within the internal cure chamber and, in one embodiment, may be mounted to the upstanding wall 22. Alternatively, the heater may be disposed external to the internal cure chamber and connected thereto via a duct which, in turn, may be covered by a grate or the like and may include a filter for removing at least some particulates. The heater may also include a fan 39 for circulating the heated air through the internal cure chamber. In this regard, any slight gap between the outer edge of the covering and the floor would serve to facilitate the circulation of the heated air through the internal cure chamber in instances in which the heater is disposed external to the internal cure chamber.

In order to properly cure the workpiece 12, the structure 10 preferably includes means for monitoring the temperature of the internal cure chamber 16. As such, the structure may include a thermometer or other temperature sensing device 40 within the internal cure chamber, such as mounted upon the upstanding wall 22 as shown in FIG. 2. The temperature sensing device may provide an indication of the temperature within the internal cure chamber that is displayed or otherwise reviewed external to the internal cure chamber. The heater typically includes a thermostat for permitting adjustment of the temperature of the heated air injected into the internal cure chamber so as to correspondingly permit adjustment of the temperature within the internal cure chamber. While the thermostat associated with the heater may be manually adjusted based upon a review of the temperature of the internal cure chamber, the structure may include a controller or the like for automatically adjusting the thermostat in response to an indication by the temperature sensing device of the temperature within the internal cure chamber so as to maintain the temperature either at a constant level or according to a predetermined time and temperature schedule that is intended to promote the proper curing of the workpiece.

Once the curing is completed, the heater 38 and the fan 39 may be disengaged and the covering 20 retracted by moving the plurality of arms 30 to a position proximate the upstanding wall 22. The workpiece 12 may then be accessed and removed, if desired.

According to one advantageous embodiment, the structure 10 is adapted to be portable so as to be moved from location to location. In particular, the structure may be moved to a position proximate a first workpiece that is to be cured and may then be operated as described above so as to cure the first workpiece without ever having to transport the first workpiece to a remote cure room or the like. In this regard, the portable structure includes means for moving the structure from location to location. While the portable structure may include various means, such as skids, tracks or the like, the means for moving the cure room preferably includes a plurality of wheels 42 mounted upon lower portions of the frame 18, such as upon lower portions of the outwardly extending floor supports 26 to permit the structure to be easily moved about a shop floor or the like so as to be repositioned proximate each workpiece to be cured. As such, the portability of the structure of this embodiment should further facilitate the curing of workpieces by preventing the sometimes difficult transportation of the workpieces to a remote cure room and increasing the speed with which it is possible to transition from curing a first workpiece to curing a second workpiece since the structure need merely be wheeled from the first workpiece to the second workpiece.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A structure for housing a workpiece while at least a portion of the workpiece is curing, the structure comprising:

a tent having an inner surface comprised of a thermally insulating material, said tent defining an internal cure chamber in which the workpiece is disposed during curing, wherein at least a portion of said tent is at least partially retractable to permit introduction of the workpiece into the internal cure chamber and removal of the workpiece from the internal cure chamber; and a heater in communication with the internal cure chamber for heating the internal cure chamber to facilitate curing of the workpiece.

2. A structure according to claim 1 wherein at least a portion of said tent is flexible.

3. A structure for housing a workpiece while at least a portion of the workpiece is curing, the structure comprising:

a tent defining an internal cure chamber in which the workpiece is disposed during curing, wherein at least a portion of said tent is at least partially retractable to permit introduction of the workpiece into the internal cure chamber and removal of the workpiece from the internal cure chamber, and wherein said tent comprises an upstanding wall and a retractable portion extending downwardly and outwardly from said upstanding wall; and a heater in communication with the internal cure chamber for heating the internal cure chamber to facilitate curing of the workpiece.

4. A structure according to claim 1 wherein said tent has an inner surface comprised of a heat reflecting, fire resistant material.

5. A structure according to claim 1 wherein said tent comprises a plurality of wheels to facilitate movement of said tent between first and second locations.

6. A structure according to claim 1 further comprising a fan for circulating air through the internal cure chamber.

7. A portable structure for housing a workpiece while at least a portion of the workpiece is curing, the portable structure comprising:

a cure room defining an internal cure chamber in which the workpiece is disposed during curing, wherein said cure room is movable between at least first and second locations, and wherein said cure room is thermally insulating; and a heater in communication with the internal cure chamber for heating the internal cure chamber to facilitate curing of the workpiece.

8. A portable structure according to claim 7 wherein said cure room comprises means for moving between at least the first and second locations.

9. A portable structure according to claim 8 wherein said means for moving comprises a plurality of wheels.

10. A portable structure according to claim 7 wherein said cure room comprises a tent having a frame and a covering supported by said frame.

11. A portable structure according to claim 10 wherein at least a portion of said covering is flexible.

12. A portable structure for housing a workpiece while at least a portion of the workpiece is curing, the portable structure comprising:

a cure room defining an internal cure chamber in which the workpiece is disposed during curing, wherein said cure room is movable between at least first and second locations, wherein said cure room comprises a tent having a frame and a covering supported by said frame, and wherein said tent comprises an upstanding wall and a retractable portion extending downwardly and outwardly from said upstanding wall; and a heater in communication with the internal cure chamber for heating the internal cure chamber to facilitate curing of the workpiece.

13. A portable structure according to claim 10 wherein said covering has an inner surface with at least a portion of the inner surface comprised of a heat reflecting, fire resistant material.

14. A structure for housing a workpiece while at least a portion of the workpiece is curing, the structure comprising:

a tent defining an internal cure chamber in which the workpiece is disposed during curing, said tent comprising:

a frame; and a covering supported by said frame, wherein said frame is adapted to move between a first position which defines an opening to the internal cure chamber to permit introduction of the workpiece into the internal cure chamber and removal of the workpiece from the internal cure chamber and a second position in which the opening is closed while the workpiece is cured.

15. A structure according to claim 14 wherein said frame comprises an upstanding wall and at least one arm extending outwardly from said upstanding wall.

16. A structure according to claim 15 wherein said frame further comprises a plurality of arms extending outwardly from a lower portion of said upstanding wall, said plurality of arms adapted to move between a first position in which said arms extend upwardly along said upstanding wall and a second position in which said are fanned outwardly from said upstanding wall so as to define different, respective angles with said upstanding wall.

17. A structure according to claim 14 wherein said tent further comprises at least one strap for engaging said covering while said frame is in the first position.

18. A structure according to claim 14 wherein said covering has an inner surface comprised of a thermally insulating, heat reflecting, fire resistant material.

19. A structure according to claim 14 further comprising means for moving between at least first and second locations.

20. A structure according to claim 19 wherein said means for moving comprises a plurality of wheels to facilitate movement of said tent between the first and second locations.

21. A method of curing a workpiece comprising:

retracting at least a portion of a tent to provide an opening to an internal cure chamber defined by the tent;

introducing the workpiece into the internal cure chamber;

repositioning at least a portion of the tent to close the opening; and curing the workpiece within the internal cure chamber.

22. A method according to claim 21 further comprising:

retracting at least a portion of a tent to define the opening to the internal cure chamber following curing of the workpiece; and removing the workpiece from the internal cure chamber through the opening defined by the retracted portion of the tent.

23. A method according to claim 21 wherein curing the workpiece comprises:

heating the internal cure chamber; and circulating air through the heated internal cure chamber.

24. A method according to claim 21 wherein retracting at least a portion of a tent comprises folding at least a portion of the tent in an accordion-like fashion.

* * * * *